United States Patent [19]

Wallace

[11] Patent Number: 4,463,513

[45] Date of Patent: Aug. 7, 1984

[54] SHAPING BALLOONS AND INFLATABLE SPHERES

[76] Inventor: Cornelius J. Wallace, 839 Clarence Ave., Bronx, N.Y. 10465

[21] Appl. No.: 414,416

[22] Filed: Sep. 2, 1982

[51] Int. Cl.[3] ..... A63H 3/06

[52] U.S. Cl. ..... 446/222

[58] Field of Search ..... 46/87, 89, 90, 88

[56] References Cited

U.S. PATENT DOCUMENTS

| | | | |
|---|---|---|---|
| 1,098,286 | 5/1914 | Miller | 46/90 |
| 1,220,874 | 3/1917 | Miller | 46/90 |
| 2,826,000 | 3/1958 | Fischman et al. | 46/87 X |

*Primary Examiner*—Mickey Yu

*Attorney, Agent, or Firm*—Richard M. Goldberg

[57] ABSTRACT

A balloon in the shape of an apple when inflated, comprising an elastically expansible balloon having an opening for introducing a gas to inflate the balloon; an anchor wrapped at least partially by an external portion of the balloon; a valve secured to the balloon at the opening, the valve having a first end extending outwardly from the balloon and a second end extending inwardly within the balloon, the valve having a circumferential wall defining a first through aperture for introducing gas to inflate the balloon and a second aperture in the circumferential wall at the second end, and the valve further having a flange about which the balloon extends at the opening; two parallel elongated guides extending entirely within the balloon and having a first end for securing the external portion of the balloon to the anchor and a second end secured to the valve at the second aperture; and an adapter disc having a central aperture through which the balloon extends, the adapter disc being in abutting relation with the flange when the balloon is inflated.

4 Claims, 4 Drawing Figures

10
11
12
13
14
15
16
17
18
19
20
21

SHAPING BALLOONS AND INFLATABLE SPHERES

BACKGROUND OF INVENTION

This invention is a method to alter and control the shape of ordinary novelty balloons, plastic spheres and inflatables so as to produce shapes resembling fruits and vegetables i.e. apples, oranges pumpkins and tomatoes. This invention will increase the novelty potential of these products and supply the market place with a new dimension in which to grow.

SUMMARY OF THE INVENTION

The invention is comprised of an internally attached pliable guide contained wholly within the inflatable sphere and connected between inside top of the inflatable sphere to the end of the valve extending within the balloon at the base of the sphere. Adjustments of the pliable guide with variations of the stem shape and the disc adapter according to the present invention allows pressures on the inflatable sphere walls to vary and form shapes other than round i.e. oval, indented, flat etc.

DETAILED DISCLOSURE

Figures 1, 2, 3, 4:
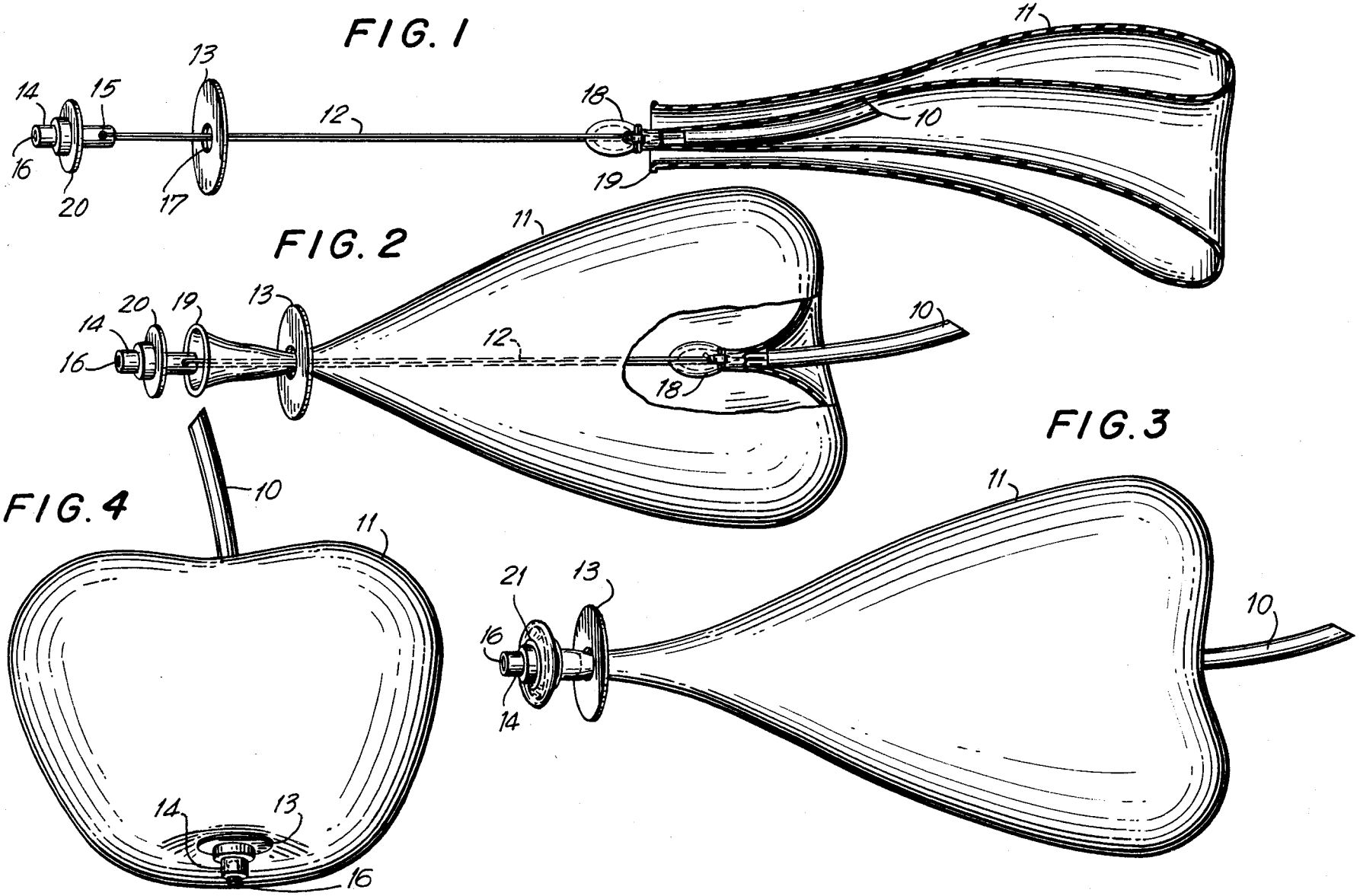
FIG. 1 is a schematic perspective view of an inflatable sphere according to this invention in the assembling stage prior to being inflated.
FIG. 2 is a schematic perspective view partially in phantom, of the partially inflated sphere of FIG. 1 in a partially assembled state, in which the opening of the balloon is not secured to the valve merely for illustration purposes.
FIG. 3 is a schematic perspective view of the three quarter inflated sphere of FIG. 1 with the disc adapter and the sphere base forming an air-tight seal to the inflator valve.
FIG. 4 is a schematic perspective view of fully inflated sphere.

In FIG. 1, there is shown an anchor or stem 10 placed inside an uninflated sphere or balloon 11 having its external surface or portion opposite the opening thereof wrapped at least partially about the base of stem 10 at location 18. A predetermined length of pliable guides 12 are provided, one end secured at location 18 at the base of the stem 10 and the other end threaded through hole 17 in a disc adapter 13 and then through a hole 15 in inflator valve 14, returning through hole 17 to location 18 and secured thereat. In FIG. 2, there is shown the partially inflated sphere at opening 19 thereof passed through disc adapter hole 17 and opening 19 ready to be adjusted around circular flange 20 on inflator valve 14. In FIG. 3, there is shown sphere opening 19 placed around circular flange 20 on valve 14 and secured externally to valve 14 by a band 21 around the narrow section of valve 14 to form an air-tight seal, thus allowing inflation of sphere 11 only through valve inflation opening 16.

In FIG. 4, there is shown one of many possible shapes, for example, an apple shape as shown, achievable by variations of stem 10, adjustable guides 12 and external adapter disc 13 in conjunction with valve 14.

I claim:

1. A balloon comprising:

elastically expansible balloon means having an opening for introducing a gas to inflate said balloon means;

first anchor means wrapped at least partially by an external portion of said balloon means;

valve means secured to said balloon means at said opening, said valve means having a first end extending outwardly from said balloon means and a second end extending inwardly within said balloon means, said valve means having a circumferential wall defining a first through aperture for introducing gas to inflate said balloon means and a second aperture in said circumferential wall at said second end;

elongated guide means extending entirely within said balloon means and having a first end for securing said external portion of said balloon means to said first anchor means and a second end secured to said valve means at said second aperture.

2. A balloon according to claim 1; in which said balloon means is in the shape of an apple when inflated.

3. A balloon according to claim 1; in which said guide means includes two parallel guides connected between said external portion of said balloon means wrapped at least partially about said first anchor means and said valve means at said second aperture.

4. A balloon according to claim 1; in which said valve mans includes flange means about which said balloon means extends at the opening thereof; and further including adapter disc means having a central aperture through which said balloon means extends, said adapter disc means being in abutting relation with said flange means when said balloon means is inflated.

* * * * *